United States Patent [19]

Ward et al.

[11] 3,990,354

[45] Nov. 9, 1976

[54] ENVELOPE MAKING APPARATUS

[75] Inventors: James O. Ward; Eugen Schang, both of Portland, Oreg.

[73] Assignee: Pak-Well Corporation, Denver, Colo.

[22] Filed: Apr. 21, 1975

[21] Appl. No.: 570,002

[52] U.S. Cl. ..... 93/62; 93/74

[51] Int. Cl.[2] ..... B31B 19/74

[58] Field of Search ..... 93/61 R, 62, 61 AC, 93/74, 75, 61 A, 63 R

[56] References Cited

UNITED STATES PATENTS

| | | | |
|---|---|---|---|
| 2,348,864 | 5/1944 | Staude | 93/74 X |
| 2,690,102 | 9/1954 | Halahan et al. | 93/61 AC |
| 3,166,996 | 1/1965 | Sauerman | 93/62 |
| 3,452,652 | 7/1969 | Berkley | 93/62 |

*Primary Examiner*—James F. Coan

*Attorney, Agent, or Firm*—Kolisch, Hartwell, Dickinson & Stuart

[57] ABSTRACT

Envelope making apparatus including a frame and conveyor means on said frame for transporting envelope blanks along a path. Stations distributed along this conveyor means form an envelope blank into an envelope structure comprising a body and at least one open flap lying transversely of the direction of travel of the conveyor means. A conveyor mechanism extends transversely of the conveyor means described, and transports an envelope structure away from said conveyor means with this open flap paralleling the direction of travel of the conveyor mechanism. A gumming station provided in said conveyor mechanism applies deposits of gum to the body and flap of the envelope structure.

8 Claims, 5 Drawing Figures

A
B
C
D
E
F
G
10
12
14
15
16
18
19
20
22
22a
22b
22c
24
27
28
30
36
38
40
50
52
54
60
62
64
69
70
76
78
80
90
95
100
106
130
136
200
204
21
420
2
4
5

ENVELOPE MAKING APPARATUS

This invention relates to envelope making apparatus, and more particularly to such apparatus equipped to apply gum deposits to envelopes. The apparatus is particularly adapted to produce so-called self-sealing envelopes. Self-sealing envelopes require cooperating gum deposits (usually of the latex type) applied both to the flap and to the body of the envelope, which adhere together with folding over of the flap on the envelope body to produce a sealed envelope.

One object of the invention is the provision of envelope making apparatus capable of making envelopes with cooperating self-sealing gum deposits on the body and flaps, respectively, which operates rapidly to produce such envelopes as a continuous operation starting with the usual envelope blanks.

Another object is to provide such apparatus which requires a minimal amount of supervision, in that ordinarily one operator can handle the input and output from the apparatus.

A further object of the invention is the provision of envelope-making apparatus wherein an envelope structure comprising an envelope tube open at opposite ends is produced by scoring, adhesive applying and folding stations provided at points distributed along an elongated conveyor means, and flaps at opposite ends of such tube are processed to be folded over and secured to the body of the structure and to have self-adhering gum deposits deposited thereon, respectively, as such structures are then moved laterally of such conveyor means. The apparatus contemplated also includes a conveyor for transporting the envelopes that result during a drying period, which delivers envelopes after drying at a point adjacent the feed end of the envelope-making apparatus.

Another object is to provide envelope making apparatus which is flexible in operation, in that such is readily changed between an operating mode producing so-called self-sealing envelopes, and an operating mode producing other types of envelopes.

Yet another object of the invention is the provision of mechanism for applying gum deposits to envelope structures, which performs such operation rapidly and with minimal maintenance problems.

These and other objects and advantages will become more fully apparent from the following description to be taken in conjunction with the accompanying drawings, wherein.

Figures 1, 2:
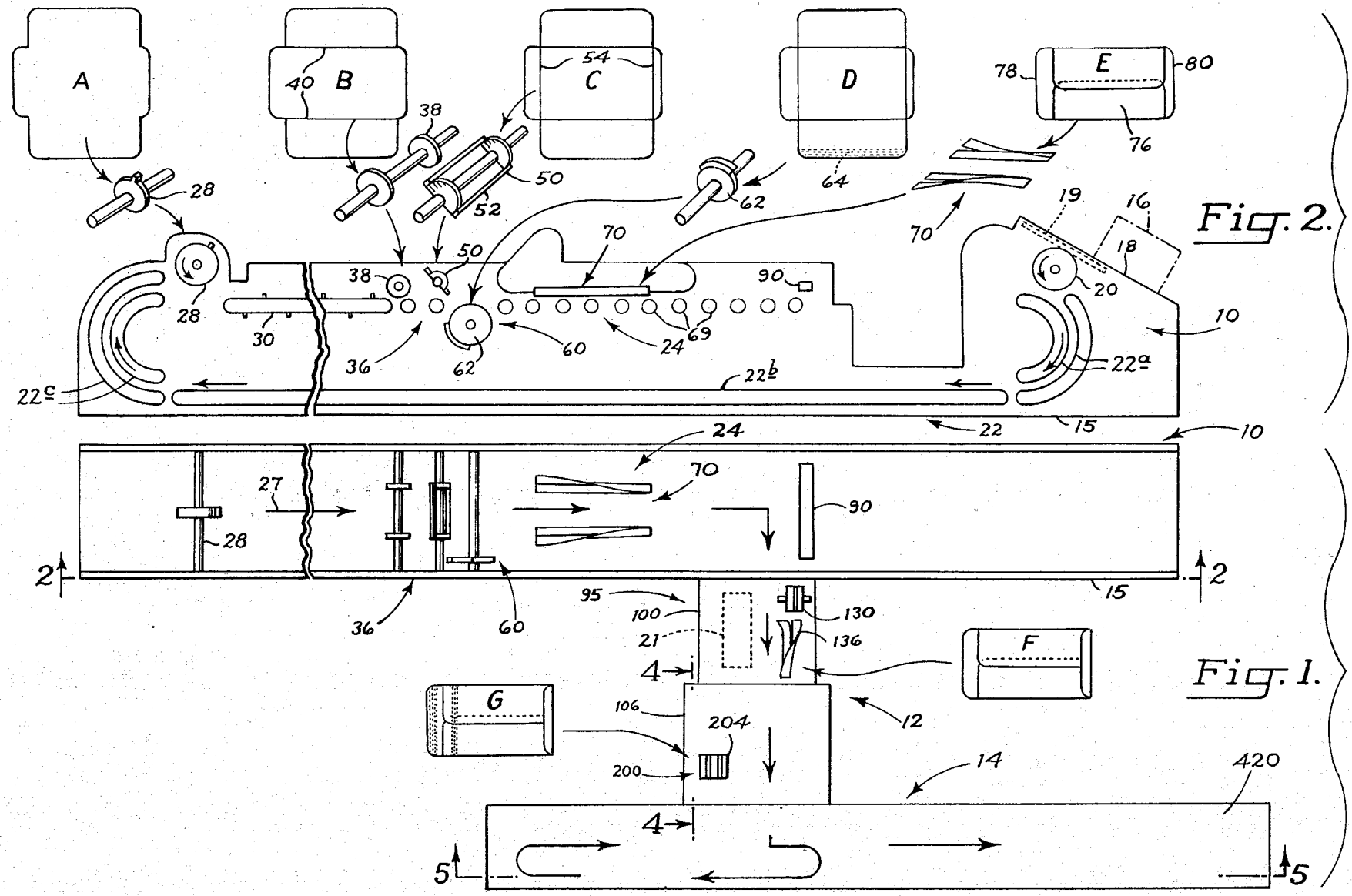
FIG. 1 is a plan view, in somewhat simplified form, illustrating envelope making apparatus as contemplated by a preferred embodiment of the invention.
FIG. 2 is a side elevation, also in simplified form, of a portion of the apparatus illustrated in FIG. 1 and taken generally along the line 2—2 in FIG. 1.

Referring now to the drawings, and first of all more particularly to FIGS. 1 and 2, the apparatus illustrated comprises an elongate section 10 which extends along one side of the apparatus, a laterally extending section 12 projecting out to one side of the elongate section 10, and an elongate section 14 extending transversely of the laterally extending section 12.

Section 10 of the apparatus includes the usual frame 15 supporting the operating parts of the section. A stack of envelope blanks 16 is supported adjacent the feed end of the apparatus on a support generally indicated at 18. Blanks are moved off the base of this stack, one at a time, to start their forward progress through the machine, utilizing conventional feed discs generally shown at 19 and a conventional power-driven rotatable pickup roller shown at 20.

Progressing from the pickup roller 20, the blanks travel along a conveyor means extending generally longitudinally of elongate section 10. This conveyor means, which is powered by a motor 21, includes what is referred to herein as an outgoing conveyor section, indicated generally at 22, for the most part extending along the base of elongate section 10, and operable to convey the blanks from the feed end of the apparatus to the opposite extremity of section 10, and a return conveyor section, given the general reference numeral 24, which returns toward the feed end of the apparatus. Any of various forms of conventional conveying apparatus may be employed in the construction of these conveyor sections, as specifics of the conveyor system form no part of this invention. Shown as part of outgoing conveyor section 22 are cooperating curved belt reaches **22*a* feeding blanks to a conveyor belt system 22*b* which delivers blanks to cooperating curved belt reaches 22*c*.**

Conveyor section 24 operates to move the envelope blanks from left to right in FIG. 2 (and FIG. 1) thus to return the blanks toward the feed end of the apparatus. As the blanks travel toward the feed end of the apparatus, a number of work operations are performed thereon, at work stations distributed along the conveyor section, which function to convert a blank into an envelope structure comprising an envelope tube closed along opposite margins that extend along the direction of travel of the conveyor, and having open flaps at opposed margins normal to these said closed margins. The instrumentalities which perform these various work operations are by themselves conventional, and thus in FIG. 2 (and in FIG. 1), the instrumentalities have been for simplicity reasons shown diagrammatically where such are located along the length of the conveyor section. Also shown to one side of the apparatus are envelope blanks, illustrating how a blank is changed after having a specific work operation performed thereon.

The arrows 27 in FIG. 1 indicate the travel direction of the envelope blanks after reaching the return conveyor section. Further explaining, envelope blanks after being deposited at the left end of the return conveyor section are drawn forwardly and spaced from one another by what is referred to herein as a pull-out segment 28. Such includes a roller, with a projection thereon, and when the roller is rotated, the projection comes into contact with a blank, whence it moves the blank forwardly from succeeding blanks and deposits the blank on register chains shown at 30. These register chains, which are part of the return conveyor section, move the blanks, one at a time, forwardly along the return conveyor section in proper timed relation to have succeeding work operations performed thereon. A blank traveling on the register chains typically may have the profile illustrated by the blank A shown in FIG. 2.

Shown at 36 is a scoring station provided with a rotatable scorer 38 that functions to crease or score a blank with score lines extending in the direction of travel of the blank. These score lines, shown at 40 in the blank identified by the letter B, delineate the inner margins of side flaps in the envelope blank. After passing scorer 38, the envelope blank passes under a rotatable scoring device 50 having transverse scoring blades 52 which score the blank with score lines extending transversely of the travel of the envelope blank. These score lines, shown at 54 in blank C, delineate inner margins of the end flaps in the forming envelope.

With further travel of the blank along the return conveyor section, such passes through an adhesive applying station 60 where a rotatable roller such as the one shown at 62 applies adhesive to the under margin of a side flap in the envelope blank. In the envelope blank depicted at D, such adhesive deposit is shown at 64.

Further travel of the envelope blank along the return conveyor section, as on the power driven rollers 69 shown, passes the blank through a folding station where the blank passes under a plow share folder 70 having cooperating folding blades which fold the side flaps in the blank over on each other, with the flap having the adhesive deposit on its underside being folded under the flap on the opposite side of the blank. The envelope structure which results, which may then be advanced under a smoothing roll (not shown), is shown at E, and comprises what is referred to herein as an envelope tube having a body 76 closed along opposite side margins which parallel the direction of travel of the return conveyor section, and opposed open flaps 78, 80 at opposed margins normal to the margins which are closed. This envelope tube is advanced by the return conveyor section against an abutment 90 which stops further forward travel of the envelope structure.

After striking the abutment, an envelope structure, i.e., the open-ended envelope tube described, starts travel along a laterally extending conveyor section 95 which extends laterally of the outgoing and return conveyor sections 22, 24. This laterally extending conveyor section comprises a feed portion 100 equipped with conveying rollers (not shown) similar to rollers 69 power driven by motor 21. These rollers are mounted on the same frame as the frame mounting outgoing and return conveyor sections 22, 24, i.e., frame 15. Also part of the laterally extending conveyor section is an offbearing conveyor portion 106. Conveyor portion 106 is mounted on a separate frame, and is part of an envelope making machine which is separable from the envelope machine which includes the outgoing and return conveyor sections 22, 24 and feed portion 100 of conveyor section 95. As will hereinafter become more fully apparent, the envelope making machine which includes conveyor portion 106 also includes a gumming station for applying a latex-type gum as required in self-sealing envelopes, and a drying conveying section for conveying envelopes during a drying period after such gum has been applied. Furthermore, the frame of this machine is wheel supported. As a result, the machine including conveyor portion 106, the gumming station, and the drying conveyor section may be disconnected and rolled away from the machine that includes outgoing conveyor 22, return conveyor 24 and feed conveyor portion 100, in the event it is desired to manufacture other types of envelopes.

As best seen in FIG. 1, positioned along feed portion 100 of the laterally extending conveyor section are an adhesive-applying station 130, including a roller adapted to apply an adhesive to one of the end flaps of an envelope structure (this time along the upper surface of such flap as such is conveyed along feed portion 100), and a folding station 136, comprising a plow share folder which serves as the envelope structure passes thereby to fold over the end flap having the adhesive deposit. The envelope structure produced by the first machine section, therefore, may be like the one shown at F in FIG. 1, which has opposed side margins closed off by side flaps that have been folded toward each other, one end margin closed off by a folded-over flap, and one end margin which is open and which has an open end flap extending from the body of the envelope structure.

Figure 3:
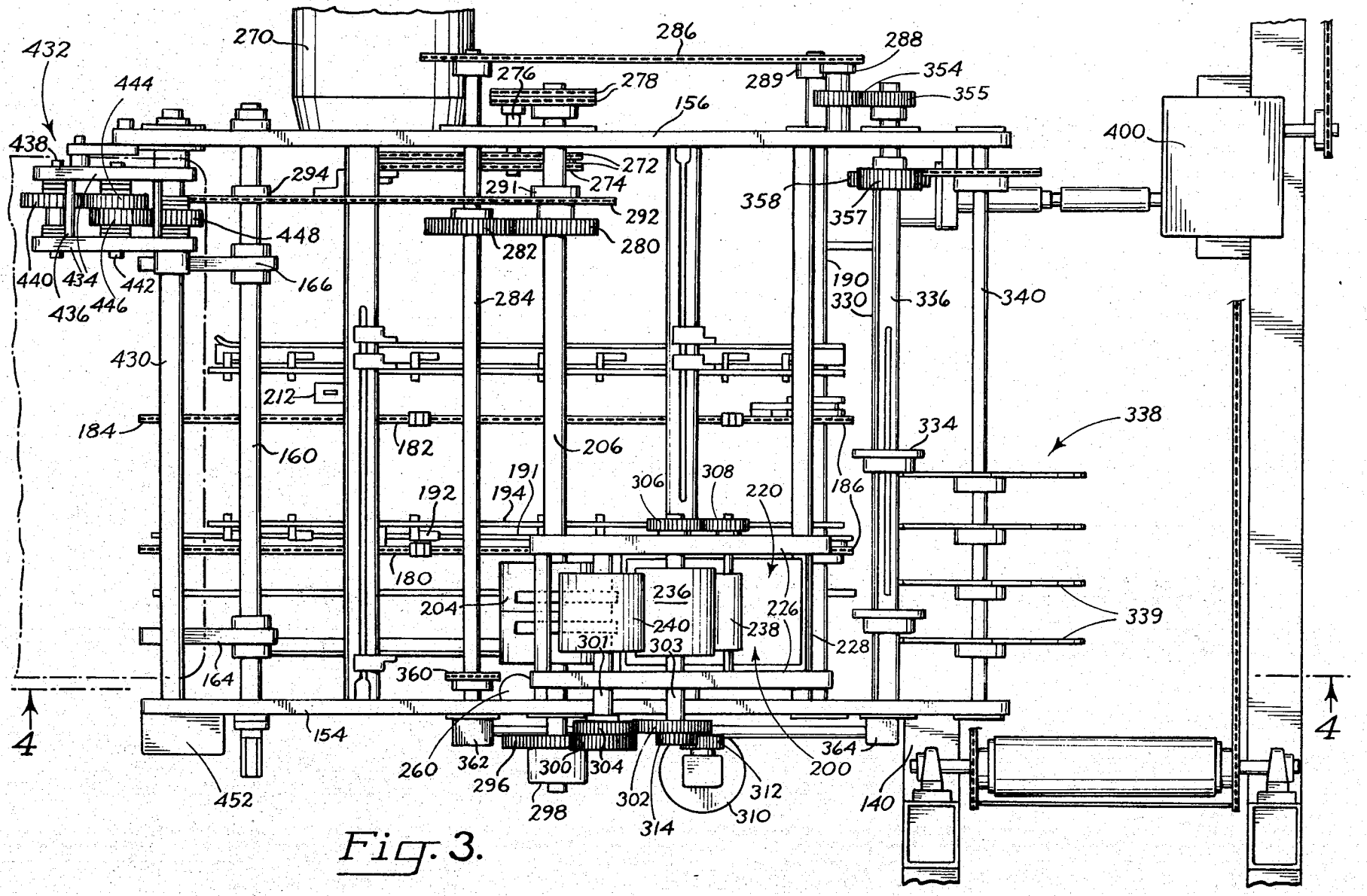
FIG. 3 is a plan view, and in greater detail, of that part of the envelope making apparatus which is operable to apply cooperating gum deposits to the body and flap of an envelope structure to convert the same to a self-sealing envelope.
Figure 4:
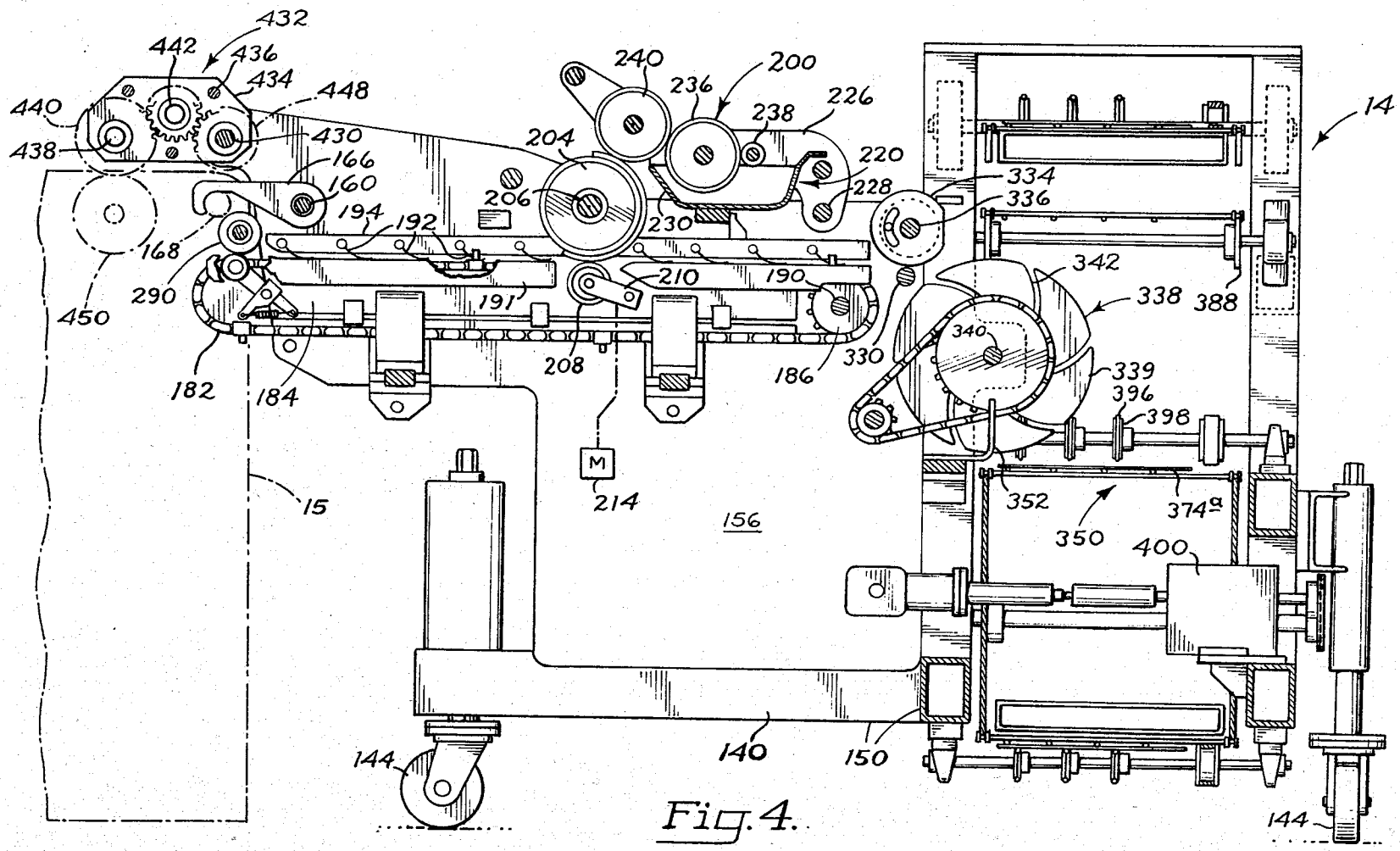
FIG. 4 is a side elevation view, taken generally along the line 4—4 in FIG. 3.
Figure 5:
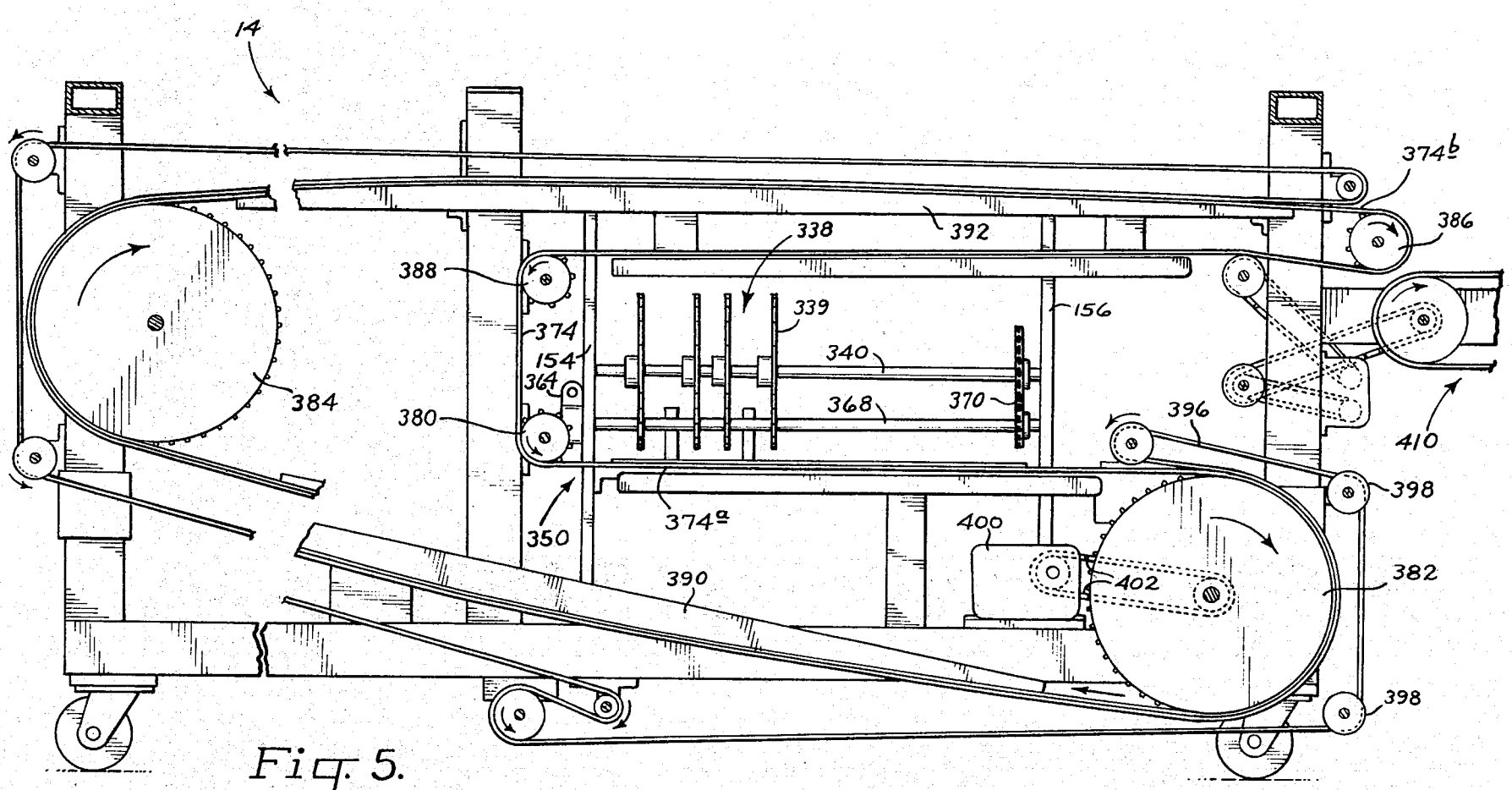
FIG. 5 is an elevation view with portions removed, taken generally along the line 5—5 in FIG. 1, showing in more detail a section of the apparatus where drying of the applied gum deposits takes place.

As perhaps best illustrated in FIGS. 3, 4 and 5, which illustrate details of the machine including offbearing conveyor portion 106, the gumming station, and the drying conveyor section, such machine comprises a suitable frame 140 supported on caster wheels 144 which provide rolling support for the frame when it is desired to move the machine from one place to another. The frame includes beams along the base, as exemplified by beams 150, and opposed upstanding side plates 154, 156 suitably supported by said beams serving as a mounting for various operating parts in the machine.

Spanning plates 154, 156, and with ends journaled in the plates, is a latch arm mounting shaft 160. A pair of laterally spaced latch arms 164, 166 are suitably secured to shaft 160. As shown best in FIG. 4, and as exemplified by latch arm 166 shown, the arms have hooked ends embracing a rod 168 forming part of frame 15 in the machine including the outgoing and return conveyor sections 22, 24. The latch arms comprise detachable means detachably joining the frame of the machine including the gumming station with the frame of the machine including the outgoing and return conveyor sections. To disconnect the two frames a crank handle is placed on the end of shaft 160 and the shaft rotated which raises the two latch arms.

Offbearing portion 160 of the laterally extending conveyor section comprises a pair of register chains 180, 182 trained at one set of ends over sprockets 186. Guide plates 184 support upper reaches of these chains. Sprockets 186 are secured to a shaft 190, supported on side plates 154, 156, and as will be described hereinbelow, shaft 190 is rotated under power to produce movement of the upper reaches of chains 180, 182 from left to right in FIGS. 3 and 4. Envelopes deposited on the register chains are advanced by these chains, while pressed downwardly on stationary guides 191 by spring fingers 192 depending from bars 194 suitably mounted on frame 140.

Illustrated generally at 200 in FIGS. 3 and 4 is what is referred to herein as a gumming station, which is operable to apply two deposits, in the form of elongate narrow ribbons, of latex gum to an envelope structure carried through the station by chains 180, 182. As shown in FIG. 1, and with reference to the structure G, one deposit is applied to the surface of the open flap of the envelope structure, and one deposit is applied to an adjacent margin of the body of the envelope structure. The deposits are positioned on the envelope structure so that on turning over of the open flap, the two deposits merge to produce self-sealing of the envelope.

Referring again to FIGS. 3 and 4, gumming station 200 comprises an applicator roller means 204 secured to a shaft 206 having opposite ends journaled in plates 154, 156. Positioned beneath roller means 204 is a backup roller 208 journaled on an arm 210 suitably pivotally mounted on frame 140. The backup roller and roller means 204 define a bite between them, and an envelope, on being advanced forwardly by chains 180, 182, passes between such bite to have any gum carried by the roller means 204 transferred to upwardly facing portions of the envelope structure. In the case of any interruption in the travel of envelope structures along the laterally extending section, such is detected by a suitable switch such as switch 212 (see FIG. 3) to actuate a motor 214 such as a solenoid (see FIG. 4) operable to swing the backup roller downwardly and away from the roller means 204.

Gum supply means 220 supplies gum to the periphery of roller means 204. Specifically, such comprises opposed and suitably interbraced mounting plates 226 journalled on a shaft 228 spanning plates 154, 156. Rotatably carried by the mounting plates are pickup roll 236, doctor roll 238, and a transfer roll 240 which contacts applicator roller means 204 with mounting plates 226 in the position shown in FIG. 4. A tray 230 mounted on frame 140 of the machine holds a source of gum with the lower part of roll 236 being submerged in such gum.

A motor 260 (see FIG. 3) functions when actuated to swing mounting plates 226 upwardly slightly, to lift transfer roller 240 out of engagement with roller means 204. Actuation of motor 260 occurs in response to stopping of motor 270 through suitable control circuitry (not shown) which senses this stoppage. This prevents a buildup of gum on the periphery of the applicator roller means in the event that applicator roller means 204 stops rotating by reason of motor 270 stopping.

Power to drive offbearing conveyor portion 106 of the laterally extending conveyor section, as well as the applicator roller means, is derived from a motor or powered means 270.

Further explaining, as best illustrated in FIG. 3, the output shaft of motor 270 is connected through chains 272 trained about a sprocket 274 to a shaft 276. Shaft 276 is drivingly connected through chains 278 to shaft 206 having applicator roller means 204 mounted thereon.

A gear 280 on shaft 206 meshes with a gear 282 mounted on a shaft 284 which is journaled on plates 154, 156, to the left of shaft 206 in FIG. 3. Shaft 284, through a chain 286, sprocket 288, and sprocket 289 mounted on shaft 190 establishes a driving connection between motor 270 and the register chains of the offbearing conveyor section.

To facilitate the movement of envelope structures off feed portion 100 of the laterally extending section and onto offbearing portion 106, a rubber surfaced roller 290 (see FIG. 4) is provided, which has opposite ends journaled in plates 154, 156. Referring again to FIG. 3, drive to this shaft is transmitted from shaft 206 via a chain 292 trained over a sprocket 291 secured to shaft 206. Chain 292 extends over an idler sprocket 294 journaled on shaft 160, and is also trained over another sprocket (not illustrated) fixed to shaft 290.

With continued reference to FIG. 3, shaft 206 mounting the applicator roller means is also provided, at its lower end as viewed in FIG. 3, with a gear 296 joined to the shaft through an overrunning clutch 298. With mounting plates 226 of gum supply means 220 lowered, gear 296 meshes with a gear 300 secured to a shaft 301 which mounts transfer roll 240, whereby the transfer roll is rotated in timed relation to the movement of the applicator roller means and the register chains which carry the envelope structures beneath the applicator roller means. Gear 302 secured to shaft 303 mounting pickup roll 236 meshes with a gear 304 on shaft 301, to transmit drive from the transfer roll to the pickup roll. Drive from pickup roll 236 to doctor roll 238 is via meshing gears 306, 308.

It will be noted in FIG. 3 that a motor 310 is illustrated, which drives through a gear box a gear 312. Gear 312 meshes with a gear 314 which is also mounted on shaft 303 mounting roll 236. This motor or power drive means ordinarily is not energized. Should motor 270 be stopped so as to stop movement of the applicator roller means and register chains 180, 182 in the offbearing portion of the conveyor section, as already explained, motor 260 is actuated to lift transfer roller 240 slightly. The control circuitry which actuates motor 260 also operates to energize motor 310. With energizing of motor 310, rolls or rollers 240, 236, and 238 are rotated under power by motor 310. This inhibits drying of the gum on the various roll surfaces involved. When mounting 226 is shifted upwardly by motor 260 to move the transfer roll out of engagement with the applicator roll means, the movement is not so great as to shift gear 300 out of engagement with gear 296. Overrunning clutch 298 earlier described accommodates turning of gear 296 which is in meshed relation with gear 300, during the time that rotation of shaft 206 is stopped.

Referring to FIG. 4, envelope structures, after having gum deposits applied to their bodies and flaps, respectively, move onto a shaft 330 and thence are advanced by pullout segments 334 mounted on a shaft 336 onto a delivery wheel means 338. Such delivery wheel means includes laterally spaced discs 339 mounted on a shaft 340, the discs having elongate elliptically shaped slots 342 therein adapted to receive the envelopes. The operation of the pullout roller means is in timed relation to the passage of these slots adjacent shaft 330. The delivery wheel means carries the envelopes forwardly and downwardly, and functions to deposit the envelopes on the feed end of a drying conveyor section 350. The envelopes move off the delivery wheel means and onto the drying conveyor section on coming against abutment fingers 352.

Motor 270, and referring to FIG. 3, drives shaft 336 having the pullout segments, through chain 286 earlier described, and gears 353, 355 operatively connecting sprocket 288 training chain 286 with shaft 336. Drive to shaft 330 is through gear 357 on shaft 336 which meshes with a gear 358 secured to shaft 330.

Still referring to FIG. 3, shaft 284 through a chain 360 transmits drive through a gear box 362 to a worm and bevel gear unit 364 which includes a bevel gear mounted on a shaft 368 (see FIG. 5) spanning plates 154, 156 in a region below shaft 340. A chain 370 interconnects shaft 368 and shaft 340 having the delivery discs or wheels mounted thereon.

Referring now more particularly to FIGS. 4 and 5, the drying conveyor section comprises an elongated conveyor chain belt system 374 having a horizontal reach 374*a* passing under the delivery wheel means. Training the belt system at opposite extremities of this reach is sprocket structure 380 and an enlarged sprocket structure 382. The belt system travels in the direction of the arrows indicated in FIG. 5, and progressing from the enlarged sprocket structure 382, the belt system travels over another enlarged sprocket structure 384, and thence about sprocket structures 386, 388, to return to the horizontal reach 374*a*. Supports 390, 392 slidably support the belt system where such extends between sprocket structures 382, 384 and sprocket structures 394, 382. Hold-down straps 396 hold the envelopes against the conveyor chain belt system as they are moved along by the system. Such hold-down straps are trained about suitable roller guides 398 as illustrated in FIG. 5. Drive for conveyor belt system 374 of the drying conveyor section is derived from a gear box 400 connected by chain 402 to sprocket structure 382. Motor 270 is drivingly connected to the gear box. Gear box 400 permits adjustment of overlying relation of envelopes on the chain belt system.

Also part of the drying conveyor section is a conveyor table shown generally at 410 in FIG. 5, which forms an extension of reach 374*b* of belt system 374. Envelopes deposited on this conveyor table are carried to the offbearing end of the envelope making apparatus, which is indicated at 420 in FIG. 1.

Envelopes moving onto the delivery wheel means 338 move forwardly and downwardly to be deposited on reach 374*a* of belt system 374. Upon being deposited on this reach of the belt system, the envelopes have been inverted from the position that they had when moving through the gumming station. Successive envelopes or envelope structures deposited on belt system 374 of the drying conveyor section ordinarily are placed in overlapping relation on the belt system, with the last deposited envelope overlapping the one which immediately preceded it. By reason of the inversion which takes place in the envelopes on their moving onto the belt system, portions of the envelopes carrying freshly applied gum deposits face downwardly. Referring to FIG. 5, when an envelope is deposited on reach 374*a*, and since reach 374*a* is moving from left to right in FIG. 5, the closed end or margin of the just deposited envelope leads the end or margin having the open flap. As a consequence, upon an envelope being deposited on reach 374*a*, it is the closed end or margin of this envelope that overlaps the envelope preceding it. The open flap containing the fresh gum deposit of the last deposited envelope, however, lies beyond the envelope structure immediately preceding it. In this way, successive envelope structures are prevented from adhering one to another as they are carried along by the drying conveyor section.

Motor 270 has been described which powers movement of the applicator roller means in the gumming station, and the registry chains, as well as other operating parts of the machine which includes the gumming station. It will be remembered that the machine which includes the outgoing and return conveyor sections as well as feed portion 100 of the laterally extending conveyor section is powered by a motor 21. As a consequence, it is desirable to establish a timed relation between the movement of the register chains in the machine which includes the gumming station, with movement of the envelope structures in the machine which include the outgoing and return conveyor sections.

To these ends, and referring to FIGS. 3 and 4, it will be noted that the machine which includes the gumming station and the register chains further is provided with a shaft 430 spanning plates 154, 156 of frame 140, having opposite ends journaled in these plates. Shown at 432 is a gear box unit, comprising opposed mounting plates 434 suitable interbraced as by pins 436, mounted with plates 434 journaled on shaft 430.

A stubshaft 438 journaled in plates 434 mounts a gear 440. A similar stubshaft 442 journaled in plates 434 has secured thereto gears 444, 446. Gear 446 meshes with a gear 448 which is secured to shaft 430, and gear 444 meshes with gear 440.

Gear box unit 432, which is swingable about shaft 430 by reason of journaled mounting of plates 434 on this shaft, is adapted to be positioned as shown in FIG. 4 with gear 440 meshing with a gear 450 which is part of the drive system provided in the machine including the outgoing and return conveyor sections and feed portion 100 of the laterally extending conveyor section. Referring to FIG. 3, it will be noted that shaft 430 has a tachometer generator 452 mounted on one end thereof, this generator being electrically connected to the controls of motor 270 whereby it controls the running speed of motor 270. With the construction described, the powered movement of the register chains and the applicator roller means of the gumming station, as well as other operating parts in the machine including the gumming station, is coordinated or in timed relation to the powered movement of the conveyor system in the machine having the outgoing and return conveyor sections.

It will be noted from the above description, and referring to FIG. 1, that envelope making apparatus has been described which may be readily operated by a single operator, by reason of the offbearing end 420 of the apparatus being spaced laterally from but adjacent the feed end (which is where the stack of blanks 16 is located). The same operator, therefore, can take care of keeping the apparatus supplied with blanks as well as the handling of the envelopes after their manufacture.

The envelope making apparatus contemplated is capable of running at relatively high speeds. All creasing, folding, adhesive, and gum applying steps are performed as the function of the blank or the forming envelope structure moving forwardly on the conveyor means provided and past an agency which performs this function.

The apparatus furthermore is versatile in operation. To modify the apparatus to produce another type of envelope, it is a simple matter to remove the machine including the gumming station from the machine including the outgoing and return conveyor sections, using the latch devices described.

It is claimed and desired to secure by Letters Patent:

1. In envelope making apparatus, a frame and a conveyor means on said frame for transporting envelope blanks along a path, stations distributed along said conveyor means for forming an envelope blank into an envelope structure comprising a body closed along opposed margins that parallel the direction of travel of said conveyor means and having at least one open flap lying transversely of said direction of travel, a conveyor mechanism extending transversely of said conveyor means for transporting an envelope structure away from said conveyor means with said structure traveling on said conveyor mechanism with said open flap paralleling the direction of travel of said conveyor mechanism, and a gumming station provided in said conveyor mechanism, for applying deposits of a sealing gum to said body and to said open flap, respectively, said gumming station including a gum applicator roller means adapted to have gum applied thereto and operable to apply gum to said body and flap through rolling on said body and flap, and gum supply means for said applicator roller means including a pickup roll and a transfer roll with the latter contacting the applicator roller means, said gum supply means further having means actuatable to shift said transfer roll away from the applicator roller means to move the transfer roll out of contact therewith, and powered means for rotating said transfer roll under power when the same is shifted away from said applicator roller means, said transfer roll being rotated independently of said powered means when in contact with said applicator roller means.

2. The apparatus of claim 1, which further includes a backup roller disposed below said applicator roller means defining with said applicator roller means a bit through which an envelope structure travels during the application of deposits of gum thereto, and means for shifting said backup roller away from said applicator roller means with an interruption in the feed of envelope structures to the applicator roller means by said conveyor mechanism.

3. An envelope making machine comprising a frame, an elongate conveyor mechanism mounted on said frame adapted for the movement therealong of an envelope structure where such structure includes a body and an open flap joined to a margin of said body and such structure is oriented with said margin paralleling the direction of travel of said conveyor mechanism, gum applicator roller means disposed above said conveyor mechanism positioned rollingly to contact the body and flap of an envelope structure moved thereunder by said conveyor mechansim, gum supply means for said applicator roller means including a pickup roll and a transfer roll with the latter contacting the applicator roller means, said gum supply means having means actuatable to shift said transfer roll away from the applicator roller means to move the transfer roll out of contact with the applicator roller means, and powered means for rotating the transfer roll under power when the same is shifted away from said applicator roller means, said transfer roll being rotated independently of said powered means when in contact with said applicator roller means.

4. The envelope making machine of claim 3, which further includes power means for actuating the conveyor mechanism and for rotating said applicator roller means with such rotation being in timed relation to the movement of said conveyor mechanism and which further comprises means for rotating said transfer roll means with such rotation being in timed relation to the rotation of said applicator roller means with the transfer roll means contacting the applicator roller means.

5. In envelope making equipment, a first apparatus comprising a frame, conveyor means on said frame for transporting envelope blanks along a path, and a first motor means for powering the conveyor means, said first apparatus having stations distributed along said conveyor means for forming an envelope blank into an envelope structure comprisng a body closed along opposed margins and having at least one open flap lying transversely of said margins, a second apparatus comprising a frame, conveyor mechanism mounted on said frame for tranporting an envelope structure and second motor means for powering said conveyor mechanism on said other frame, said conveyor mechanism extending away from the conveyor means of said first apparatus, said second apparatus further having a gumming station provided for applying deposits of a sealing gum to the body and flap of an envelope structure, said other frame being detachably connected to the first mentioned frame of said first apparatus, and means interconnecting the conveyor means of said first apparatus and the conveyor mechanism of said second apparatus whereby they are powered by said sirst and said second motor means in timed relation.

6. In envelope making apparatus, a frame, conveyor means on the frame for transporting envelope blanks along a path, and stations distributed along said conveyor means for forming an envelope blank into an envelope structure comprising a body closed along opposed margins that parallel the direction of travel of said conveyor means and having at least one open flap lying transversely of said direction of travel, a conveyor mechanism extending transversely of said conveyor means for transporting an envelope structure away from said conveyor means with said envelope structure traveling on said conveyor mechanism with said open flap facing upwardly and paralleling the direction of travel of said conveyor mechanism, a gumming station provided adjacent said conveyor mechanism for applying deposits of a sealing gum to said body and to said open flap, respectively, a drying conveyor section extending transversely of the offbearing end of said conveyor mechanism, and delivery means for depositing envelope structures with gum applied thereto from said conveyor mechanism onto said drying conveyor section, said delivery means operating to invert the envelope structure whereby the said open flap faces downwardly on the drying conveyor section, said drying conveyor section having means for actuating said section whereby successive envelope structures deposited thereon assume an overlapped relationship and the open flap of the last deposited envelope structure lies beyond the envelope structure immediately preceding it on the conveyor section.

7. An envelope making machine comprising, a frame, an elongate conveyor mechanism mounted on the frame for the movement therealong of an envelope structure where such structure includes a body and an open flap joined to a margin of said body and such structure is oriented with said margin paralleling the direction of travel of said conveyor mechanism, a gum applicator roller means adjacent said conveyor mechanism and positioned rollingly to contact the body and flap of an envelope structure moved thereby by said conveyor mechanism and operable to apply gum deposits to said body and flap, gum supply means for said applicator roller means including a pickup roll and a transfer roll with the latter contacting the gum applicator roller means, said gum supply means further including means actuatable to shift said transfer roll away from the applicator roller means to move the transfer roll out of contact with the applicator roller means, backup roller means disposed adjacent said applicator roller means and defining with said applicator roller means a bite through which an envelope structure travels during the application of deposits of gum thereto, and means for shifting said backup roller means away from said applicator roller means with an interruption in the feed of envelope structures past said applicator roller means by said conveyor mechanism.

8. The apparatus of claim 7, which the further includes a motor means driving said conveyor mechanism, and the transfer roll is shifted away from the applicator roller means to move it out of contact therewith with stopping of said motor means.

* * * * *